United States Patent [19]

Tang et al.

[11] 4,452,017

[45] Jun. 5, 1984

[54] AIR INFLATED BUBBLE ROOF

[75] Inventors: Man-Chung Tang; Yee-Yun Tang, both of Jamaica, N.Y.

[73] Assignee: Dyckerhoff & Widmann Aktiengesellschaft, Munich, Fed. Rep. of Germany

[21] Appl. No.: 263,185

[22] Filed: May 13, 1981

[51] Int. Cl.[3] ..... E04G 11/04; B28B 7/32

[52] U.S. Cl. ..... 52/2; 52/80; 264/32

[58] Field of Search ..... 52/80, 2, 83, 82, 22; 264/32

[56] References Cited

U.S. PATENT DOCUMENTS 3,410,039 11/1968 Brezina ..... 52/83

3,643,910 2/1972 Heifetz ..... 264/32

FOREIGN PATENT DOCUMENTS 2431233 of 1975 Fed. Rep. of Germany ..... 52/2

2724373 of 1978 Fed. Rep. of Germany ..... 52/2

*Primary Examiner*—J. Karl Bell

*Attorney, Agent, or Firm*—Toren, McGeady and Stanger

[57] ABSTRACT

An air inflated bubble roof, such as for a stadium, arena or the like, includes a compression ring extending around the perimeter of the roof. An upper and a lower cable net each spans and is attached to the compression ring. An inflatable membrane member is located between the two cable nets and bows the cable nets apart when it is inflated. A bladder is located within the inflatable membrane member and, in combination with the upper and lower parts of the membrane member, forms a seal around its perimeter.

22 Claims, 5 Drawing Figures

AIR INFLATED BUBBLE ROOF

SUMMARY OF THE INVENTION

The present invention is directed to an air inflated bubble roof such as for a stadium, arena, or similar structure, and in particular it is directed to an inflatable membrane member located between an upper and a lower cable net with the cable nets secured to a compression ring extending around the perimeter of the roof.

The use of inflated roofs has become very popular in recent years. Such roofs can be divided into two types, one, where the entire interior of the building is pressurized to maintain the roof in position such as enclosures for tennis courts, swimming pools, exhibition halls and the like, and, two, where an inflatable membrane is supported by vertical columns or similar structural supports so that only the interior of the membrane member is inflated.

If a sports stadium is to be covered by an inflatable roof, and the entire interior of the stadium must be pressurized to support the roof, a number of problems exist. The stadium must be completely closed and special entrances-exists are required to maintain the pressure within the stadium and support the roof. With such a structure, it is difficult to provide adequate ventilation at low cost and the fan horsepower required for roof stability is quite high. Another problem is that the roof has a low snow load capacity. To afford adequate strength, a double fabric is needed for the roof. The heating costs in such an arrangement are also quite high and the shape of the roof limits the effectiveness of the ventilation or cooling systems. When the interior of a stadium or building must be pressurized to support the roof, the interior surface of the roof is concave and this shape tends to accumulate haze and smoke and also causes considerable noise problems, because it concentrates crowd and mechanical sound in the center of the stadium. With a concave inside roof surface, there is the advantage that a lower support structure for the roof can be utilized than where an inflatable membrane or bubble is employed.

In U.S. Pat. No. 2,355,248, a building with an air supported roof is disclosed, however, a special means for entry and exit is needed. In U.S. Pat. No. 3,835,599 a similar roof structure is disclosed.

If an inflatable membrane or bubble is used as the roof, the sides of the stadium can be at least partially open and there is no need for special entrances and exits. The requirements for inflating the roof bubble are significantly less than are needed for inflating the entire interior of a stadium to support the roof. The interior of the stadium can be much more easily ventilated or cooled and excellent smoke removal is possible.

In an inflatable bubble roof the snow load can be handled much more easily and it is not necessary to provide any special snow melting equipment. While the convex shape of the inside surface of the roof determines the height of the supporting structure for the roof, its shape is helpful for circulating air, for smoke removal, and for lighting purposes.

Moreover, the shape of the inside surface of the roof disperses crowd sounds and does not direct them back to the playing surface within the stadium which is a definite disadvantage in the structure were the roof is pressurized from within the stadium.

In the U.S. Pat. No. 3,338,000 an inflated roof of a lenticular shape is disclosed. The interior of the building is maintained at normal atmospheric pressure. The inflatable envelope is supported on its lower surface by cables connected at their radially outer ends to a ring shaped compression member. The vertical profile of the upper membrane of the inflatable envelope is maintained by a difference in pressure between the interior of the envelope and the atmosphere. The lower membrane of the envelope is supported on flexible cables. The envelope can be laced to the compression member or ring. This inflated roof is intended for a light weight, mobile building, not for an inflatable bubble roof for use over a stadium or the like.

In U.S. Pat. No. 4,047,335 an inflatable envelope is supported by a cable system with a diaphragm system within the envelope for transmitting the load from the outside to the cables. The interior of the inflatable envelope is divided by vertical diaphragms and the envelope is supported by a plurality of upper and lower cables. The upper cables are connected to the top edge of the diaphragms. Such an arrangement of the inflatable envelope is difficult to assemble and to mount on a supporting structure.

Therefore, it is the primary object of the present invention to provide an inflated bubble roof of a simplified construction which can be easily assembled and positioned.

In accordance with the present invention, the bubble roof is formed of an inflatable membrane positioned between an upper cable net and a lower cable net so that, as the membrane is inflated, it bows the cable nets apart with the membrane being supported on the lower cable net and with the upper cable net defining the configuration of the upper surface of the inflatable membrane.

In a preferred embodiment of the invention, the inflatable membrane is formed of an upper membrane and a lower membrane each extending substantially across the entire open space within the compression ring supporting the cable nets. A tubular shaped inflatable bladder extends around the perimeter of the upper and lower membranes and in combination with them provides a seal for the perimeter of the inflatable member. As a result, the space between the membranes is completely open, it is not divided by any diaphragms or other members extending between the upper and lower membranes. With such an arrangement the compression ring, upper and lower cable nets and the inflatable membrane can be assembled at ground level and then jacked up into position at a location on top of supporting columns.

The inflated bubble or membrane has a lenticular shape with the outside surface of the upper and lower membranes being convex. Accordingly, the upper and lower cables are correspondingly arcuately shaped. Due to the convex shape of the lower membrane, it is necessary for the compression ring to be located at a higher level above ground level than in the case of a concave roof surface supported by the pressure within a building. In a baseball stadium a height of 190 feet is required between the playing surface and the lowest point of the roof above the playing surface. While an extra height is required for the roof bubble of the present invention, there is the advantage that it affords space for additional seating and for ventilation equipment.

If the bubble roof of the present invention is constructed at ground level and then jacked up into its final location, the roof provides a cover over the stadium space so that construction can be carried out under the roof regardless of weather conditions.

By using a closely spaced pattern of the small cables with the cables arranged in the range of two to eight feet on centers each way, it is possible to utilize a lighter fabric for the membrane. The cables used are small and easy to fabricate and install. Since the cables are separate from the membrane they provide a simplified assembly of the upper and lower cable nets with the membrane between them. The cables can be adapted to accommodate to the various configurations of the compression ring.

The compression ring can be of a variety of shapes, such as rectangular, and it is an easy matter to hang the cables across the compression ring. By selecting the proper length of the cables the lenticular configuration of the inflatable membrane can be easily attained.

With the upper membrane of the inflatable bubble having a convex outer surface it is possible to drain snow and water to the perimeter of the roof where it is easily collected. By selecting the proper length of the cables the lower membrane of the inflatable bubble can have a smaller sag than the rise provided in the upper membrane. With a reduction in the sag it is possible to limit blockage of the line of sight across the upper region of the stadium. Since the cables have an arcuate shape, the length of the cables between their points of attachment to the compression ring is greater than the rectilinear on straight line distance between the attachment points.

It is possible to pressurize the inflatable bubble with very little air pressure, for instance about 15 pounds per square foot. If pressure is lost and the bubble deflates there is no noticeable change in the bubble shape when viewed from the inside of the stadium. If deflation should occur, a spout connected to the upper membrane can be arranged to punch through the lower membrane as it settles so that water collected in the roof structure can be drained.

The compression ring can be easily assembled at ground level from precast, prestressed concrete segments. With the ring completed, the lower cable network can be stretched across the ring. The inflatable bubble including the bladder defining its perimeter can be placed on the lower cable network and then the upper cable network can be fixed to the compression ring. Next, the bubble can be inflated until it expands against the upper and lower cable networks tensioning the cables so that the ring reacts in compression. The rigid roof structure formed by the compression ring, the cable nets and the inflated bubble can be hoisted into the final position on a prefabricated support system. As mentioned above, once the roof is in place, the space under the roof forms a protected work area. While the inflatable bubble can be constructed without the tubular bladder extending around its perimeter, the bladder has the advantage that it affords a seal between the upper and lower membranes and facilitates the construction of the bubble and the subsequent formation of the inflated bubble roof. Moreover, the position and shape of the bladder more accurately locates and shapes the upper and lower cable nets.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
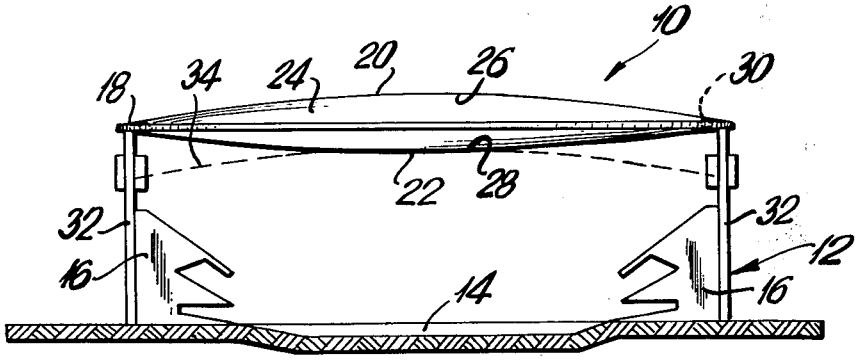
FIG. 1 is a schematic view of the air inflated bubble roof of the present invention positioned over a stadium.

In FIG. 1 an air inflated bubble roof 10 is shown spanning a stadium 12 covering both the playing field 14 and the spectator stands 16. The bubble roof 10 includes a compression ring 18 extending completely around the perimeter of the roof with an upper cable net 20 and a lower cable net 22 secured to the compression ring. A lenticular shaped, inflated bubble or membrane 24 is shown between the upper and lower cable nets 20, 22 with the membrane placing the cable nets in the desired configuration. The inflated membrane includes an upper membrane part 26 bearing against the upper cable net 20, a lower membrane part 28 bearing against the lower cable net 22 and a tubular shaped bladder 30 located between the upper and lower membrane parts and defining the perimeter of the membrane. The upper and lower membrane parts 26, 28 are sealed to the bladder 30 so that the membrane 24 forms a completely open space interiorly of the bladder 30 and between the upper and lower membrane parts 26, 28.

As shown in FIG. 1, both the upper and lower membrane parts 26, 28 have a convex outside surface in contact with the corresponding cable nets 20, 22 so that the cables forming the cable nets each have a similar convex arcuate convex shape.

Figure 3:
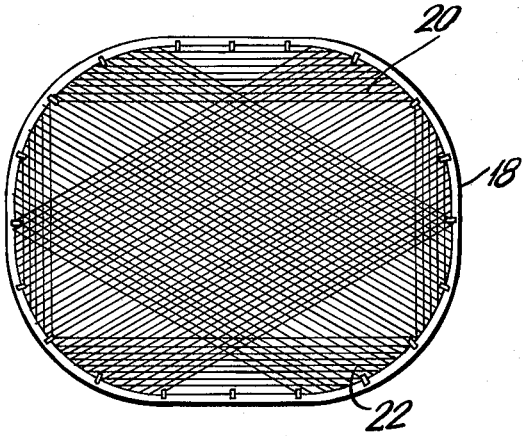
FIG. 3 is a plan view of the compession ring and cable net support for the inflated bubble.

The outside wall of the stadium 12 includes a number of vertical columns 32 supporting the compression ring 18. The shape of the compression ring 18 depends on the lateral perimeter configuration of the stadium. As shown in FIG. 3 it is generally rectangularly shaped with rounded corners. However, the compression ring can be circular, oval, elliptical or other annular configuration. The compression ring 18 is formed of prefabricated, prestressed concrete sections joined together to form the ring.

By carefully selecting the length of the individual cables in the upper and lower cable nets 20, 22, when the bubble or membrane 24 is inflated at a relatively low pressure, for instance, about 15 pounds per square foot, the cable nets bow apart and assume the desired shape. Accordingly, each cake has a length between its attachment points greater than the rectilinear dimension between the attachment points. Preferably, the sag in the lower cable net 22 below a horizontal plane tangent to the lower surface of the bladder 30 is less that the rise of the upper cable net 20 above a horizontal plane tangent to the upper surface of the bladder. As a result, the extent to which the bottom of the bubble roof 10 extends downwardly is limited so that it provides the least interference ith the line of sight across the stadium.

The dashed line in FIG. 1 indicates the roof line 34 if the roof is of the type supported by air pressure maintained within the stadium. While it is possible to reduce the overall height of the stadium using a roof supported by air pressure within the stadium, it would be necessary to provide special entrances and exits and to enclose the stadium completely to retain the air pressure. Further, it can be appreciated with the concave shape shown by the dashed line 34, there is a tendency to trap smoke under the roof so that it provides a problem. Further, the concave shape has a tendency to direct sound back onto the playing field where it can be a problem for the players. With the convex shape of the bottom surface of the bubble roof of the present invention, air is deflected outwardly to the perimeter of the stadium and the space in the stadium side walls below the compession ring 18 can be used for ventilation.

Initially, the compression ring 18 and the remainder of the bubble roof 19 can be assembled at ground level and then the entire roof structure can be jacked up on support columns into the final position such as shown in FIG. 1.

Figure 2:
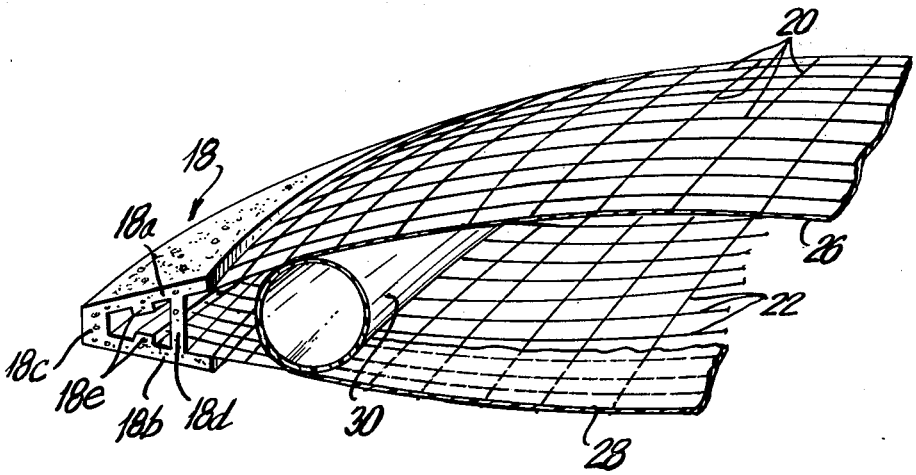
FIG. 2 is a perspective view of a portion of the bubble roof shown in FIG. 1.
Figure 4:
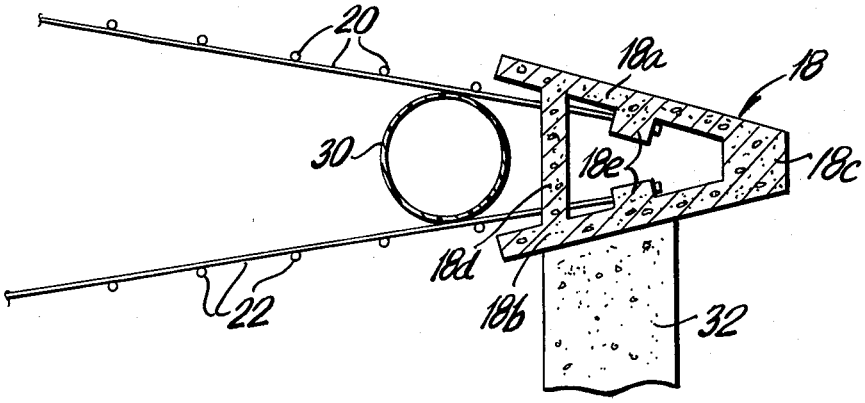
FIG. 4 is a partial side view of the bubble roof.

In FIGS. 2 and 4 one preferred shape of the transverse cross section of the compression ring 18 is illustrated having the shape of an "A" laying on its side. The compression ring has an upper leg 18*a* and a lower leg 18*b* with the legs converging outwardly and joined together by a bight portion 18*c*. Adjacent the inner ends of the legs 18*a*, 18*b* a vertical strut 18*d* extends between them. Located within the space defined radially outwardly by the bight portion 18*c* and radially inwardly by the strut 18*d* are cable connectors 18*e* of a conventional type to which the individual cables of the cable nets 20, 22 are anchored. The compression ring 18 is supported by columns 32. The size of the columns depends on the overall size of the stadium and the spacing between adjacent columns. In one embodiment, the columns have a size approximately 6 feet by 8 feet. The compression ring mounted on the columns has a horizontal dimension of about 18 feet, a vertical dimension at the radially outer side of about 4 feet and at the radially inner side of about 14 feet.

In FIG. 3 the general arrangement of the cables forming the upper and lower cable nets 20, 22 is shown. The cables extend generally chordally across the compression ring 18 being anchored in the ring in the manner shown in FIG. 4. The number and spacing of the cables depends on the overall dimensions of the compression ring and on the size of the cables used. The cable spacing can be in the range of two to eight feet apart. By carefully selecting the length of the individual cables, it is possible to determine the exact sag of the bubble roof as well as its rise when the membrane 24 is inflated.

The bubble or membrane 24 formed of the upper membrane part 26 and the lower membrane part 28 is sized to provide the desired inflated bubble for bowing the upper and lower cable nets 20, 22 apart when the bubble is inflated. The membrane can be formed of standard weight plastics material film and does not require the double weight film needed where the roof is supported by the pressure within the building or stadium. The bladder 30 is tubular shaped and extends completely around the inside of the compression ring between the upper and lower membranes providing a seal with these membranes for the perimeter of the bubble. The bladder 30 provides a support for the cables at the perimeter of the inflated membrane or bubble so that the cables can be led properly into the anchors formed in the compression ring 18. When the bubble is inflated the bladder is also inflated and in one embodiment the bladder has a diameter of about eight feet, the sag in the lower membrane below the bladder is about 20 feet while the rise in the upper membrane above the bladder is about 25 feet. A relatively small amount of air is needed to inflate the bubble and requires a relatively small fan horsepower as compared to the fan requirements where the roof is maintained in its proper position by the air pressure within a building or stadium.

By using a membrane with an upper and lower membrane part, the inflated bubble can avoid to a great extent the passage of light through the roof which might cause some problems.

Figure 5:
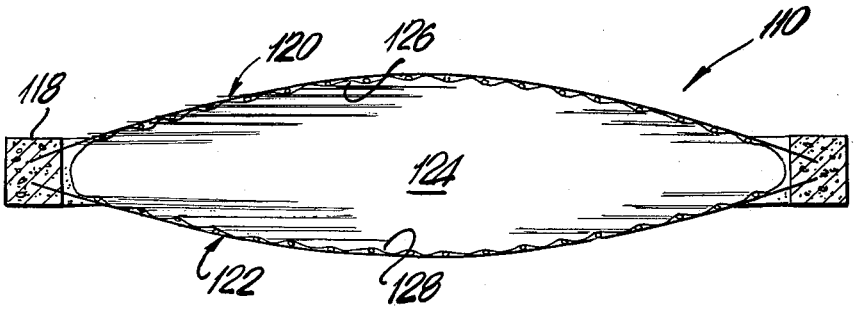
FIG. 5 is a sectional view of another embodiment of the present invention.

In FIG. 5 another embodiment of the present invention is illustrated with the compression ring 118 extending around the perimeter of the roof. The roof bubble 110 is formed by an upper cable net 120 and a lower cable net 122. Between the cable nets is an inflated membrane 124 consisting of an upper membrane part 126, a lower membrane part 128 with the perimeter edges of the upper and lower membranes being joined together forming a seal for the membrane. Unlike the arrangement disclosed above, in this embodiment the perimeter of the membrane 124 is not provided with an annular bladder.

The upper and lower cable nets 120, 122 include cables extending chordally across the space to be covered by the roof with the opposite ends anchored into the compression ring 118.

By utilizing the air inflated bubble roof of the present invention it is possible to construct a stadium or building which can remain open. The roof is self-supporting and is able to support the snow load. Further, the configuration of the upper membrane part supported against the upper cable net assures adequate drainage of rain or snow off the roof to the perimeter where it can be carried away in troughs to downspouts.

With this type of roof it is possible to avoid any light from passing downwardly through the roof membrane and interfering with sight within the stadium. In lighting the stadium, lights can be hung from the cables. It is not necessary to integrate the membrane fabric with the cables and this feature simplifies the construction of the membrane and the assembly of the overall roof structure.

While specific embodiments of the invention have been shown and described in detail to illustrate the application of the inventive principles, it will be understood that the invention may be embodied otherwise without departing from such principles.

We claim:

1. Air inflated bubble roof comprising a compression ring defining the perimeter of a space to be covered by the roof, a lower cable net and an upper cable net each connected to said compression ring so that said nets span the space encircled by said compression ring, said lower cable net and upper cable net each formed of a number of cables arranged in at least two layers one above the other with the cables in one layer extending transversely of the cables in the other layer and each having a length between the connections to said compression ring greater than the rectilinear dimension between the connections, an inflatable membrane member located between said lower and upper cable nets and in the inflated condition said membrane member contacts and bows said upper and lower cable nets away from one another providing the membrane with a lenticular shape and providing said cables forming said upper and lower cable nets with an arcuate shape, said inflatable member comprising an upper membrane part and a lower membrane part and when inflated to form the bubble roof said upper membrane part remains in contact with said upper cable net and said lower membrane part remains in contact with said lower cable net, and means located between the lower and upper membrane parts for forming a seal between the lower and upper membrane parts of said inflatable membrane member adjacent to the outer edges of said membrane parts extending around the perimeter of the roof.

2. An air inflated bubble roof, as set forth in claim 1, wherein said means comprises an annular member extending completely around the perimeter of said inflatable member and disposed in sealed contact with said upper and lower membrane parts.

3. An air inflated bubble roof comprising a compression ring defining the perimeter of a space to be covered by the roof, a lower cable net and an upper cable net each connected to said compression ring so that said nets span the space encircled by said compression ring, said lower cable net and upper cable net each formed of a number of cables each having a length between the connections to said compression ring greater than the rectilinear dimension between the connections, an inflatable membrane member located between said lower and upper cable nets and in the inflated condition said membrane member bows said upper and lower cable nets away from one another providing the membrane member with a lenticular shape and providing said cables forming said upper and lower cable nets with an arcuate shape, said inflatable member comprising an upper membrane part and a lower membrane part, and means for forming a seal between the lower and upper membrane parts of said inflatable membrane member adjacent to the outer edges of said membrane parts extending around the perimeter of the roof, an annular member extending completely around the perimeter of said inflatable member and disposed in sealed contact with said upper and lower membrane parts, and said annular member comprises a continuous unitary tubular shaped bladder extending completely around the perimeter of said inflatable member.

4. An air inflated bubble roof, as set forth in claim 3, wherein said bladder being substantially circular in transverse cross section.

5. An air inflated bubble roof comprising a compression ring defining the perimeter of a space to be covered by the roof, a lower cable net and an upper cable net each connected to said compression ring so that said nets span the space encircled by said compression ring, said lower cable net and upper cable net each formed of a number of cables each having a length between the connections to said compression ring greater than the rectilinear dimension between the connections, an inflatable membrane located between said lower and upper cable nets and in the inflated condition said membrane member bows said upper and lower cable nets away from one another providing the membrane member with a lenticular shape and providing said cables forming said upper and lower cable nets with an arcuate shape, said inflatable member comprising an upper membrane part and a lower membrane part, and means for forming a seal between the lower and upper membrane parts of said inflatable membrane member adjacent to the outer edges of said membrane parts extending around the perimeter of the roof, said upper and lower cable nets each comprising a multiplicity of cables in a crossing pattern with said cables generally extending chordally of and anchored to said compression ring.

6. An air inflated bubble roof, as set forth in claim 5, wherein said compression ring having an A-shaped transverse cross section comprising a bight portion, a pair of legs disposed in diverging relationship from said bight portion inwardly toward said inflatable membrane member, a strut member extending between said legs at a position spaced inwardly from said bight portion toward the ends of said legs closer to said inflatable membrane member.

7. An air inflated bubble roof, as set forth in claim 6, wherein said compression ring having anchor members secured to each of said legs, and said cables of said upper cable net being connected to said anchor members on one of said legs and said cables of said lower cable net being connected to said anchor members on the other one of said legs.

8. An air inflated bubble roof, as set forth in claim 7, wherein said compression ring comprises a plurality of prefabricated prestressed concrete sections.

9. An air inflated bubble roof, as set forth in claim 3, wherein in the inflated condition, said lower membrane part of said membrane member having a sag below the plane defining the lower limit of said bladder which is less than the rise of said upper membrane above the plane defining the upper limit of said bladder.

10. An air inflated bubble roof comprising a compression ring defining the perimeter of a space to be covered by the roof, a lower cable net and an upper cable net each connected to said compression ring so that said nets span the space encircled by said comprssion ring, said lower cable net and upper cable net each formed of a number of cables each having a length between the connections to said compresion ring greater than the rectilinear dimension between the connections, an inflatable membrane member located between said lower and upper cable nets and in the inflated condition said membrane member bows said upper and lower cable nets away from one another providing the membrane member with a lenticular shape and providing said cables forming said upper and lower cable nets with an arcuate shape, said inflatable member comprising an upper membrane part and a lower membrane part and means for forming a seal between the lower and upper membrane parts of said inflatable membrane member adjacent to the outer edges of said membrane parts extending around the perimeter of the roof, and said compression ring has an arcuate configuration at least in part.

11. An air inflated bubble roof comprising a compression ring defining the lateral perimeter of a space to be covered by the roof, a lower cable net and an upper cable net each connected to said compression ring so that said nets span the space within said compression ring, an inflatable member located between said lower and upper cable nets and in the inflated condition said membrane member bows said lower and upper cable nets away from one another, said inflatable member comprising an upper membrane part and a lower membrane part forming a lenticular shaped space therebetween when said membrane member is inflated with air, means forming a seal for the lateral periphery of said inflatable member with the lenticular space within said inflatable member inwardly of said means and between the inside surfaces of said upper and lower membrane parts forming a single undivided open space, said means comprising an annular inflatable bladder extending completely around the lateral periphery of said inflatable member and forming a seal with said upper and lower membrane parts.

12. An air inflated bubble roof, as set forth in claim 11, wherein said bladder comprises a tubular shaped member.

13. An air inflated bubble roof comprising a compression ring defining the perimeter of a space to be covered by the roof, an arrangement of lower cables and an arrangement of upper cables, means for anchoring the opposite ends of said upper and lower cables with each of said upper and lower cables connected at least at one end to said compression ring, each of said upper and lower cables having a length between the anchoring points greater than the rectilinear dimension between the anchoring points, an inflatable member located beteen said upper and lower cable arrangements and in the inflated condition said membrane contacts and bows said upper and lower cables apart away from one another providing the membrane member with a lenticular shape and providing said upper and lower cables each with an arcuate shape, said inflatable member comprising an upper membrane part and a lower membrane part and when inflated to form the bubble roof said upper membrane part remains in contact with said upper cable net and said lower membrane part remains in contact with said lower cable net, and means located between the lower and upper membrane parts for forming a seal between the lower and upper membrane parts of said inflatable membrane member.

14. An air inflated bubble roof, as set forth in claim 13, wherein said means for forming a seal comprises an annular member extending completely around the perimeter of said inflatable member adjacent said compression ring and disposed in sealed contact with said upper and lower membrane parts.

15. An air inflated bubble roof comprising a compression ring defining the perimeter of a space to be covered by the roof, an arrangement of lower cables and an arrangement of upper cables, means for anchoring the opposite ends of said upper and lower cables with each of said upper and lower cables connected at least at one end to said compression ring, each of said upper and lower cables having a length between the anchoring points greater than the rectilinear dimension between the anchoring points, an inflatable membrane member located between said upper and lower cable arrangements and in the inflated condition said membrane bows said upper and lower cables apart away from one another providing the membrane member with a lenticular shape and providing said upper and lower cables each with an arcuate shape, said inflatable member comprising an upper membrane part and a lower membrane part, and means for forming a seal between the lower and upper membrane parts of said inflatable membrane member, said means for forming a seal comprises an annular member extending completely around the perimeter of said inflatable member adjacent said compression ring and disposed in sealed contact with said upper and lower membrane parts, and said annular member comprises a continuous tubular shaped bladder extending completely around the perimeter of said inflatable member.

16. An air inflated bubble roof, as set forth in claim 15, wherein in the inflated condition, said lower membrane part of said membrane member has a sag below the plane defining the lower limit of said bladder which is less than the rise of said upper membrane above the plane defining the upper limit of said bladder.

17. Air inflated bubble roof, as set forth in claim 15, wherein said bladder is substantially circular in transverse cross-section.

18. An air inflated bubble roof comprising a compression ring defining the perimeter of a space to be covered by the roof, an arrangement of lower cables and an arrangement of upper cables, means for anchoring the opposite ends of said upper and lower cables with each of said upper and lower cables connected at least at one end to said comprssion ring, each of said upper and lower cables having a length between the anchoring points greater than the rectilinear dimension between the anchoring points, an inflatable membrane member located between said upper and lower cable arrangements and in the inflated condition said membrane bows said upper and lower cables apart away from one another providing the membrane member with a lenticular shape and providing said upper and lower cables each with an arcuate shape, said inflatable member comprising an upper membrane part and a lower membrane part, and means for forming a seal between the lower and upper membrane parts of said inflatable membrane member, and said upper and lower cable arrangements each comprises a multiplicity of cables disposed in a crossing pattern with at least certain of said cables extending chordally of and anchored at the opposite ends thereof to said comprssion ring.

19. An air inflated bubble roof, as set forth in claim 18, wherein said compression ring having an A-shaped transverse cross section comprising a bight portion, a pair of legs disposed in diverging relationship from said bight portion inwardly toward said inflatable membrane member, a strut member extending between said legs at a position spaced inwardly from said bight portion toward the ends of said legs closer to said inflatable membrane member and spaced radially outwardly from the ends of said legs.

20. An air inflated bubble roof, as set forth in claim 19, wherein said compression ring having anchor members secured to each of said legs, and said upper cables are connected to said anchor members on one of the said legs and said lower cables are connected to said anchor members on the other one of said legs.

21. An air inflated bubble roof, as set forth in claim 20, wherein said compression ring comprises a plurality of prefabricated prestressed concrete sections.

22. An air inflated bubble roof comprising a compression ring defining ther perimeter of a space to be covered by the roof, an arrangement of lower cables and an arrangement of upper cables, means for anchoring the opposite ends of said upper and lower cables with each of said upper and lower cables connected at least at one end to said compression ring, each of said upper and lower cables having a length between the anchoring points greater than the rectilinear dimension between the anchoring points, an inflatable membrane member located between said upper and lower cable arrangements and in the inflated condition said membrane bows said upper and lower cables apart away from one another providing the membrane member with a lenticular shape and providing said upper and lower cables each with an arcuate shape, said inflatable member comprising an upper membrane part and a lower membrane part, and means for forming a seal between the lower and upper membrane parts of said inflatable membrane member, and said compression ring has an arcuate configuration at least in part of the annular direction thereof.

* * * * *